US006488071B1

(12) United States Patent
Welfonder

(10) Patent No.: US 6,488,071 B1
(45) Date of Patent: Dec. 3, 2002

(54) BLIND RAIL

(75) Inventor: Konrad Welfonder, Bremerhaven (DE)

(73) Assignee: Hunter Douglas Industries BV (NL)

( * ) Notice: Subject to any disclaimer, the term of this patent is extended or adjusted under 35 U.S.C. 154(b) by 0 days.

(21) Appl. No.: 09/641,494

(22) Filed: Aug. 18, 2000

(30) Foreign Application Priority Data

Sep. 1, 1999 (EP) ..... 99202831

(51) Int. Cl.[7] ..... E06B 9/30

(52) U.S. Cl. ..... 160/173 V; 160/178.1 V; 160/900

(58) Field of Search ..... 160/173 V, 178.1 V, 160/900, 345, 38; 16/94 D, 95 D, 87.4 R; 428/35.8, 36.9; 248/254, 262

(56) References Cited

U.S. PATENT DOCUMENTS 2,093,708 A * 9/1937 Breuer ..... 156/19
2,597,224 A * 5/1952 Charron et al. ..... 16/87.6
2,683,890 A * 7/1954 Rosenbaum ..... 16/87.4
3,346,909 A * 10/1967 Blackburn ..... 16/94
3,436,047 A * 4/1969 Foltz ..... 248/317
3,823,439 A * 7/1974 Selset ..... 16/94
4,299,008 A * 11/1981 Burns ..... 16/95 D
4,581,788 A * 4/1986 Baumann ..... 16/93 D
4,607,677 A * 8/1986 Comeau ..... 160/84 R
4,733,435 A * 3/1988 Darner ..... 16/87.4
4,791,703 A * 12/1988 Chang ..... 160/178.1 V
5,049,424 A * 9/1991 Carden et al. ..... 428/35.8
5,054,535 A * 10/1991 Rozon ..... 160/173 V
5,533,560 A * 7/1996 Morris ..... 160/178.1
5,630,457 A * 5/1997 Chou ..... 160/173 V
5,848,633 A * 12/1998 Chou ..... 160/173 V

* cited by examiner

*Primary Examiner*—Bruce A. Lev
(74) *Attorney, Agent, or Firm*—Dorsey & Whitney LLP

(57) ABSTRACT

A vertical blind (2) rail having an elongate channel (6) including a base wall (12) extending widthwise in a first direction between first and second base edges (14, 16), first and second side walls (18, 20) extending respectively from the first and second base edges to respectively first and second side edges (22, 24) in a second direction generally perpendicular to said first direction, first and second inturned flanges (26, 28) extending inwardly in generally said first direction from the first and second side edges respectively so as to define a slot (30) therebetween, wherein the vertical blind rail is formed by roll-forming a first elongate sheet into a cross-section partly conforming to the cross-section of an inner channel (10) of the blind rail, roll-forming a second elongate sheet into a cross-section partly conforming to the cross-section of an outer channel (8) of the blind rail, feeding the partly roll-formed first sheet for the inner channel into the partly roll-formed second sheet for the outer channel, and roll-forming the first and second sheets together to form the blind rail.

36 Claims, 6 Drawing Sheets

BLIND RAIL

SUMMARY OF THE INVENTION

According to this invention, there is provided a blind rail having an elongate channel including an elongate inner channel for supporting or retaining blind components and an elongate outer channel having means for mounting of the rail, said inner channel being accommodated within said outer channel.

Also according to this invention, there is provided a blind rail, as defined above, wherein said elongate channel includes:

a base wall extending widthwise in a first direction between first and second base edges;

first and second side walls, extending respectively from said first and second base edges to respectively first and second side edges in a second direction generally perpendicular to said first direction;

first and second inturned flanges extending inwardly from said first and second side edges respectively in generally said first direction so as to define a slot therebetween; and wherein said base wall, said first and second side walls and at least part of said first and second inturned flanges respectively include an inner base wall, first and second inner side walls and first and second inturned inner flanges of said inner channel.

Further according to this invention, there is provided a method of forming a blind rail as defined above comprising:

roll-forming a first elongate sheet into a cross-section partly conforming to the cross-section of the inner channel;

roll-forming a second elongate sheet into a cross-section partly conforming to the cross-section of the outer channel;

feeding the partly roll-formed inner channel into the partly roll-formed outer channel; and roll-forming the first and second sheets together to obtain the blind rail.

In this way, the elongate channel of a blind rail can be formed by roll-forming and yet still have the inner cross-section formed independently of the outer cross-section. Internal functional features can be provided without being apparent on the outside of the channel and the external section can be shaped for a pleasing appearance without affecting the functional internal features. An inner channel can be formed from an elongate sheet of preferably metal material. An outer channel can likewise be formed from an elongate sheet of preferably metal material. Also the external section or channel can be shaped for different mounting methods while at the same time having a pleasing appearance. The inner and outer sheets together provide improved strength. Furthermore, they can be made of different materials according to requirements for internal and external features. Indeed, the outer sheet forming the outer channel can be coated for a pleasing appearance, without coating the sheet forming said inner channel.

Preferably, at a position intermediate said first and second base edges and said first and second side edges respectively, the sheet forming the inner channel at least one of the first and second inner side walls is folded back on itself so as to form an inwardly facing support flange extending inwardly in generally said first direction, whereby blind components can be supported or retained by the support flange. In the case of a vertical blind head rail these support flanges can be formed to support slat carriages. In the case of a horizontal blind the support flanges can be formed to accommodate the tilt-supports. In the case of a curtain the flanges can be formed to accommodate the curtain gliders, and in the case of a roller blind, provisions can be made to carry the central shaft.

In this way, internal support provisions can be created by the sheet forming said inner channel, such as for supporting vertical blind carriers, without any effect on the outer appearance of the elongate channel.

Preferably, at least one of said first and second base edges, the sheet forming the outer channel is folded back on itself so as to form a mounting flange extending outwardly in generally said first direction, whereby the mounting flange can be used to mount the head rail adjacent to an architectural opening.

Hence, the sheet forming said outer channel can be folded so as to provide means for connecting to a mounting bracket.

Preferably, the sheets forming a first outer side wall of said outer channel, between the first base edge and the first side edge, is spaced apart from said first inner side wall. Between the first base edge and the first side edge, said first outer side wall can have a generally convex or outwardly curved outer form.

Thus, at parts of the cross-section of the elongate channel, the outer channel can take a different form to the inner channel and leave a space therebetween. Hence, the outer sheet formed into the outer channel can form a pleasing outwardly curved surface, whilst leaving the internal functional channel wall flat.

Preferably, adjacent said mounting flange, the sheet of said outer channel forming said first outer side wall is folded back on itself forming an extension extending in generally upward direction so as to hide or cover said mounting flange.

In this way, the sheet forming said outer channel can conceal features of the inner elongate channel. In particular, where the first base edge is provided with a mounting flange, by folding the outer sheet of the first side wall of said outer channel back on itself forming said extension in generally an upward direction it covers or hides the first base edge, and thus the mounting flange will also be concealed when the blind rail is installed adjacent an architectural opening.

The innermost sections of the inturned flanges defining the slot are formed only from the sheet forming said outer channel, by being folded back on itself so as to overlap on the inside of the sheet forming the inner channel.

In this way, the inner channel is securely fixed within the outer channel and the outer channel provides a complete concealment of the inner channel.

At least one edge of the sheet forming the outer channel can be folded back on itself so as to be sandwiched between the respective sheets forming said outer channel and said inner channel.

This provides a secure fixing and prevents there being any sharp edges within the channel.

The sheet forming said inner channel of at least one of the first and second inturned flanges can include an inwardly facing deflection against which an edge of the sheet forming said outer channel abuts.

In this way, where the sheet forming said outer channel is folded onto the inside of the inturned flanges, it is prevented from sliding relative to the sheet forming said inner channel, since its edge abuts the inwardly facing deflection.

Other aspects, features, and details of the present invention can be more completely understood by reference to the following detailed description of a preferred embodiment, taken in conjunction with the drawings and from the appended claims.

BRIEF DESCRIPTION OF THE DRAWINGS

FIG. 8 (*b*) illustrates the stages of partly forming the inner channel of the elongate channel of FIG. 6; and FIG. 8(*c*) illustrates the stages of forming together the partly formed inner and outer channels of FIGS. 8(*a*) and (*b*) to form the elongate channel of FIG. 6.

DESCRIPTION OF THE PREFERRED EMBODIMENTS

Figure 1:
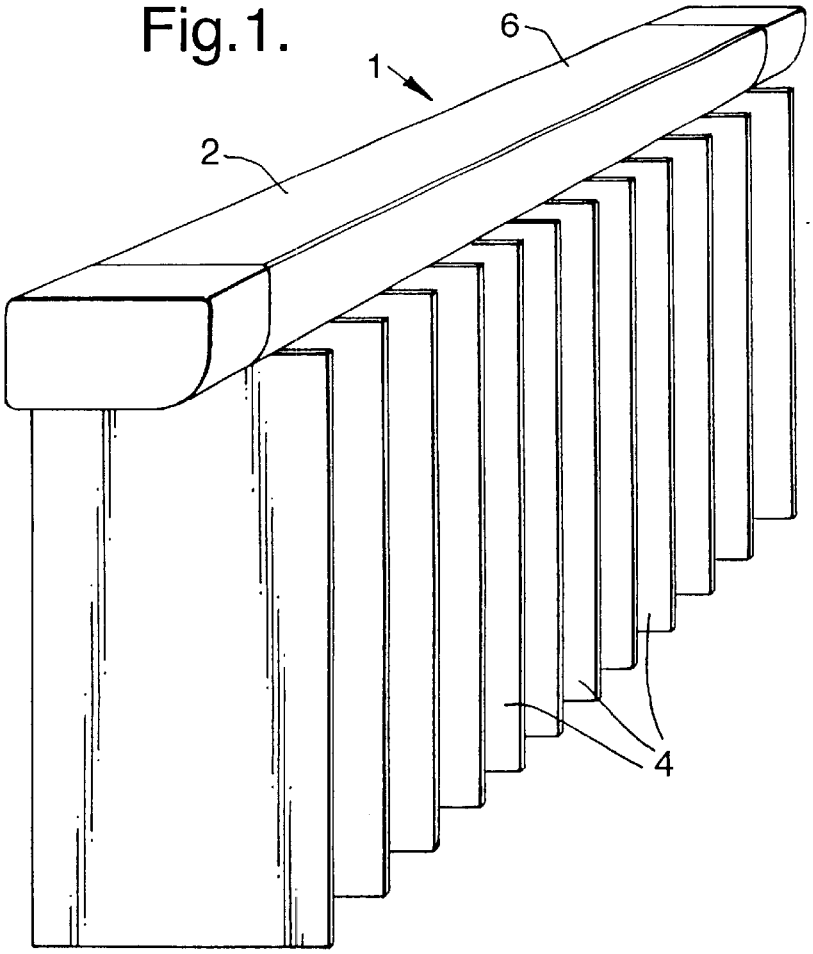
FIG. 1 illustrates a vertical blind system.

FIG. 1 illustrates a vertical blind system, generally 1, which includes a vertical blind head rail 2 for mounting above an architectural opening and conventional slats 4 hanging vertically down from the head rail so as to cover the architectural opening. The head rail 2 comprises an elongate channel 6 from which the slats 4 hang. In particular, the elongate channel 6 includes a slot (not shown) along its lower surface, through which the vertical slats can be movably suspended. Within the elongate channel 6, conventional carriers (not shown) are provided for the vertical slats 4. The carriers can be provided with conventional rollers such that they and their respective slats 4 can be moved along the length of the elongate channel 6. Furthermore, a conventional mechanism (not shown) can be provided within the head rail 2, which can be used to operate the carriers to tilt the slats 4 and extend and retract them to close and open the system.

Figure 2:
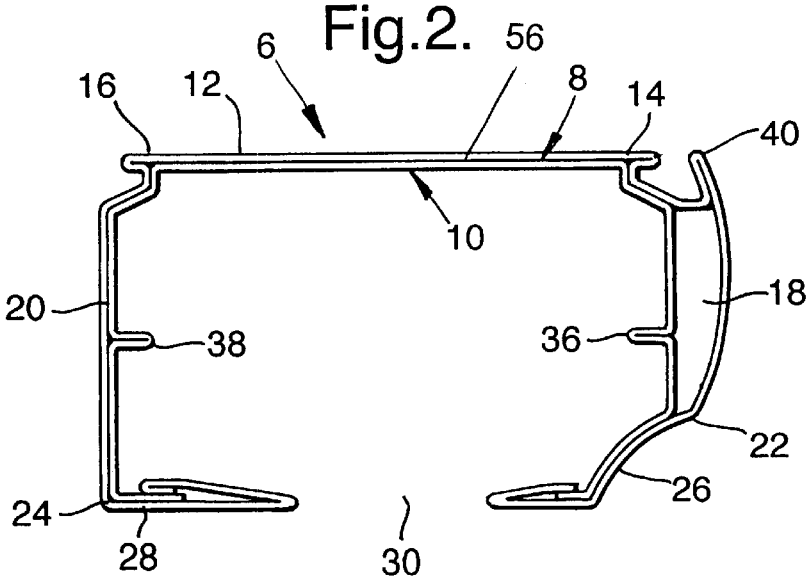
FIG. 2 illustrates the cross-section of an elongate channel for the head rail of the blind system of FIG. 1 according to a first embodiment of this invention.

FIG. 2 illustrates a cross-section through an elongate channel 6 embodying the invention. The elongate channel 6 comprises an elongated inner channel 10 of roll-formed sheet metal, illustrated independently in FIG. 3(*a*), and an elongate outer channel 8 of roll-formed sheet metal, illustrated independently in FIG. 3(*b*).

The elongate channel 6 includes a base wall 12 which, in use, is positioned uppermost above the suspended blind slats. The base wall 12 includes an inner base wall 12*a* and an outer base wall 12*b*, which co-extend widthwise between first and second base edges 14, 16 that extend along the length of the elongate channel 6.

The elongate channel 6 is also provided with first and second side walls 18, 20 on either side of the base wall 12. The first and second side walls 18, 20 are each formed by first inner and outer side walls 18*a*, 18*b*, as well as second inner and outer side walls 20*a*, 20*b* respectively. At the bottoms of the side walls 18, 20 are first and second side edges 22 and 24 from which first and second inturned flanges 26 and 28 extend inwardly. The relevant portions of the inner and outer channels 10, 8 in FIGS. 3(*a*) and 3(*b*) are referred to by similar reference numerals, with indices "a" and "b" respectively.

The first and second inturned flanges 26, 28 define the slot 30 which runs along the elongate channel 6 at its lower surface. As explained above, the slot 30 provides an opening through which the slats 4 can be movably suspended.

Figure 3A:
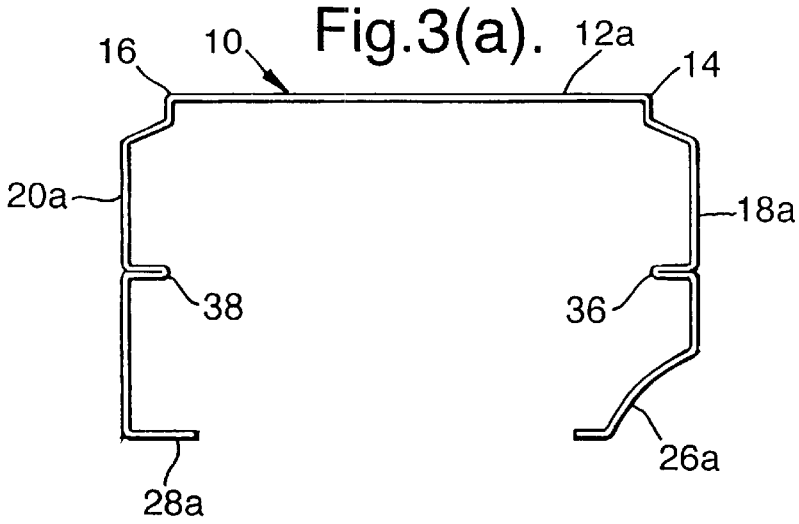
FIGS. 3(*a*) and (*b*) respectively illustrate the cross-sections of inner and outer roll-formed sheets, forming inner and outer channels of the cross-section of the elongate channel of FIG. 2.
Figure 3B:
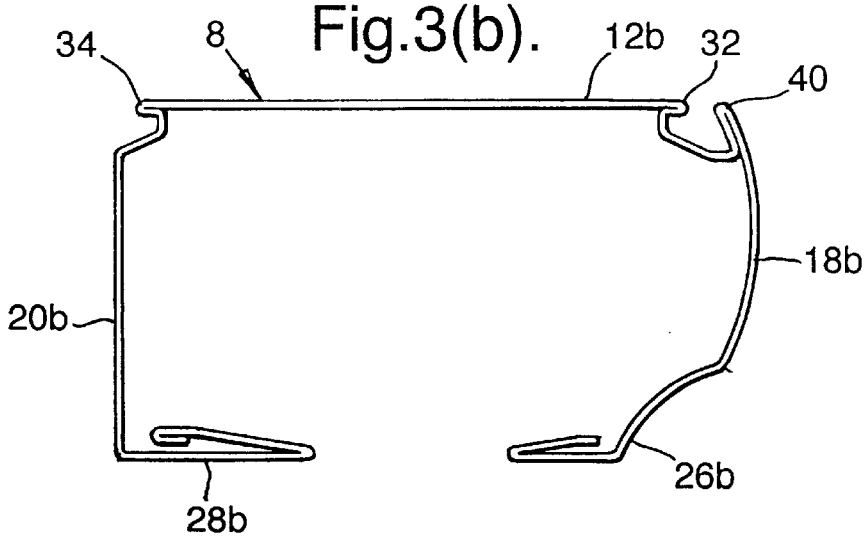

As illustrated in FIG. 3(*a*) and FIG. 3(*b*), at the first and second base edges 14*a*, 16*a* of the inner channel 10, the sheet metal of the outer channel 8 is folded back upon itself so as to form mounting flanges 32, 34. The mounting flanges extend outwardly in approximately the same direction as the extent of the base wall 12. In this way, clips can be provided to extend beneath the mounting flanges 32, 34 so as to support the blind rail and the suspended blind slats. Furthermore, the mounting flanges can be used to mount, to the blind rail, additional add-on components.

Along the inner surface of the first and second inner side walls 18*a*, 20*a*, the sheet forming the inner channel 10 is folded back upon itself so as to form inwardly facing support flanges 36, 38. The support flanges thus run inwardly of the inner channel 10 and the elongate channel 6 along the length of each. The support flanges 36, 38 can be used to support or retain components of the blind mechanism within the elongate channel 6. In particular, where movable blind slat carriers are used, the rollers of the blind slat carriers can be supported by the support flanges 36, 38.

As illustrated, formation of the support flanges 36, 38 on the inside of the inner channel 10 is independent of the outer form of the outer channel 8 and thus of the elongate channel 6. In particular, with its inner channel 10 forming functional features such as the support flanges 36, 38, the outer channel 8 of the elongate channel 6 can be formed with a more aesthetic appearance. As illustrated, at the first outer side wall 18*b*, the outer channel 8 has a generally curved or convex form along the length of the elongate channel 6. Thus, it curves away from and is spaced apart from the inner channel 10. In this way, with the blind rail mounted adjacent an architectural opening, the outer side wall 18b facing the user can have a decorative and more pleasing appearance that is independent of the functional requirements of the inner side wall 18*a*.

In the illustrated embodiment, the first outer side wall 18*b* of the outer channel 8 is further folded back upon itself in the vicinity of the inner first base edge 14. The resulting extension 40 thereby covers or conceals the mounting flange 32.

In order to provide a desired appearance, it is not necessary for the inturned flanges 26, 28 to extend in a planar form inwardly of the side walls 18, 20. Thus, as illustrated in FIG. 2, the first inturned flange 26 has a curved or concave form along a transitional portion lengthwise of the elongate channel 6 before then extending directly towards the second inturned flange 28.

At the innermost part of the outer inturned flanges 26*b*, 28*b*, the outer channel 8 is folded back on itself to sandwich the inner inturned flanges 26*a*, 28*a* of the inner channel 10 therebetween. Thereby, the folded back portions of the outer inturned flanges 26*b*, 28*b* cover and protect the free edges of the inner inturned flanges 26*a*, 28*a*. Because the outer channel 8 is of double thickness at its innermost part, i.e., at the folded back portions of the outer inturned flanges 26*b*, 28*b*, it is not necessary for the inner inturned flanges 26*a*, 28*a* to extend all the way to the innermost part of the outer inturned flanges 26*b*, 28*b*.

Indeed as illustrated in FIG. 2, mechanical support for the blind slats 4 is intended to be provided internally by the support flanges 36, 38 of the elongate channel 6, and although its inturned flanges 26, 28 can have significant mechanical strength, such strength is not necessary. Thus, the inturned flanges 26, 28 are formed substantially only from the sheet metal of the outer channel 8 folded back on itself. To avoid concern regarding sharp edges on the inturned flanges 26*b*, 28*b* of the outer channel 8, these flanges can be folded back on themselves as illustrated for the second inturned flange 28 in FIG. 2. Such an arrangement also makes it easier for the edge of the second inturned flange 28*a* of the inner channel 10 to be slid between the folded over portion of the second inturned flange 28*b* of the outer channel 8.

Figure 4:
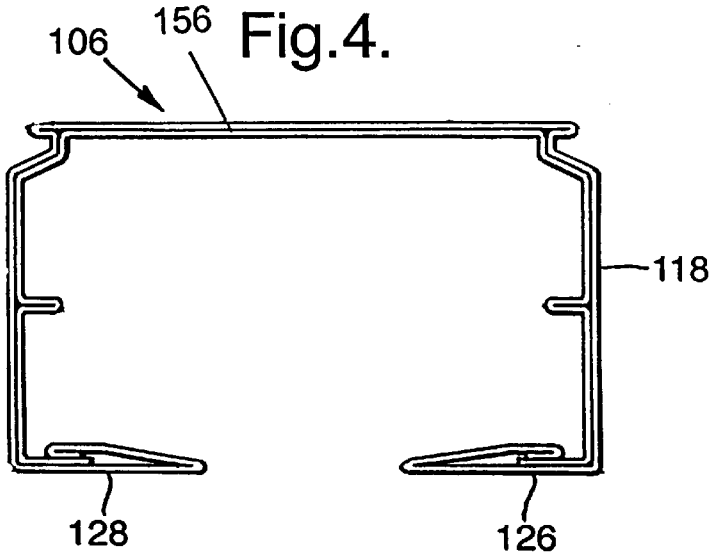
FIG. 4 illustrates the cross-section of an elongate channel for the head rail of the blind system of FIG. 1 according to a second embodiment of the invention.
Figure 5A:
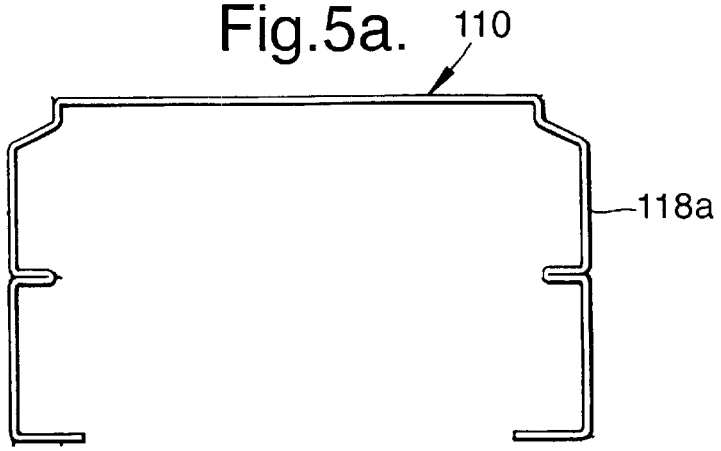
FIGS. 5(*a*) and (*b*) respectively illustrate the cross-sections of inner and outer roll-formed sheets, forming inner and outer channels of the cross-section of the elongate channel of FIG. 4.
Figure 5B:
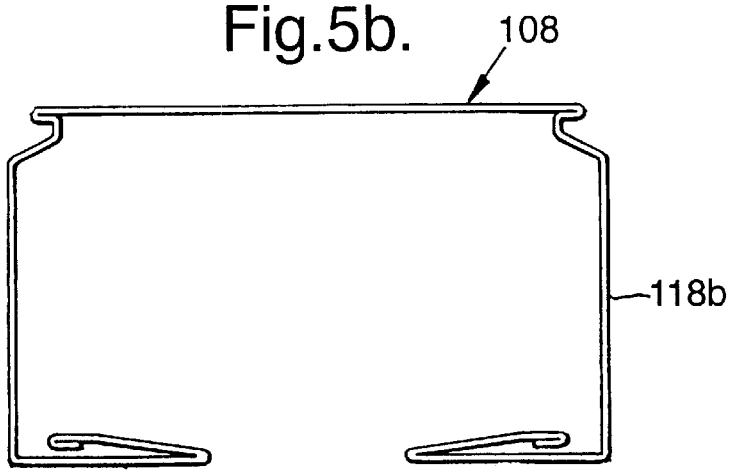

FIG. 4 illustrates an elongate channel 106 which is an alternative embodiment to that of FIG. 2, and FIGS. 5(*a*) and (*b*) illustrate respectively its inner and outer channels 110, 108 of roll-formed metal sheets. Like features have like reference numerals supplemented by "100", and the corresponding portions of the inner and outer channels 110, 108 in FIGS. 5(*a*) and 5(*b*) are referred to using indices "a" and "b" respectively.

The elongate channel 106 of FIG. 4 differs from the elongate channel 6 of FIG. 2 in that, for the first side wall 118, the outer channel 108 has a generally planar outer side wall 118*b*, which conforms to the planar form of a first inner side wall 118*a* the inner sheet metal channel 110. Furthermore, both outer and inner inturned flanges 126 and 128 are substantially planar and both include a sheet metal portion of the outer channel 108 which is folded back over the inner channel 110.

Figure 6:
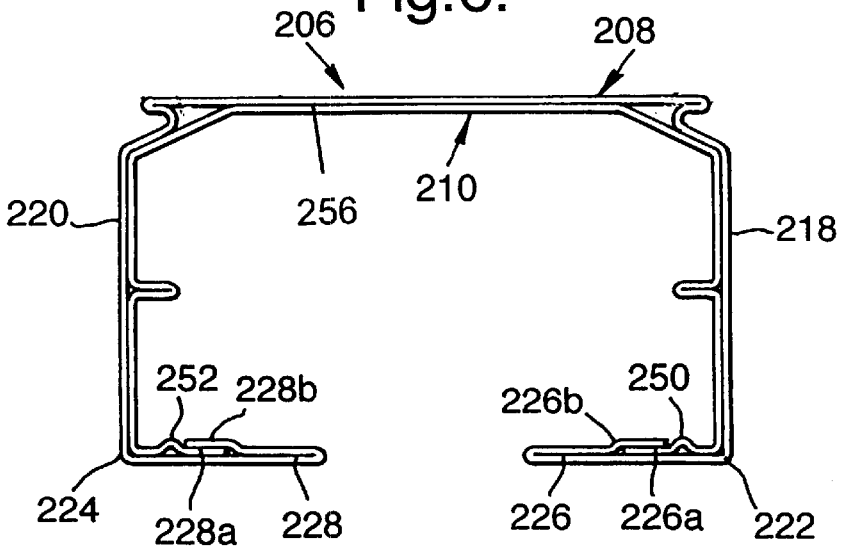
FIG. 6 illustrates the cross-section of an elongate channel for the head rail of the blind system of FIG. 1 according to a third embodiment of the invention.

FIG. 6 illustrates an elongate channel 206 which is another alternative embodiment to that of FIG. 2 and in which like features to those of FIG. 2 have like reference numerals, but supplemented by "200."

The general form of the elongate channel 206 is similar to that of FIG. 4. However, at each of the inturned flanges 226, 228, the inner channel 210 includes an inwardly facing deflection 250, 252. Each deflection is formed at an appropriate position on the inner inturned flanges 226*a*, 228*a*, relative to the outer channel 208, such that the edges of the folded back portions of its outer inturned flanges 226*b*, 228*b* come into abutment with the deflections 250, 252. This is particularly useful when the inner and outer sheets, forming the inner and outer channels 210, 208, are roll-formed together. This is because, as the elongate channel 206 is roll-formed into its final cross-section, the edges of the sheet forming its inner channel 210 are prevented from sliding towards the side edges 222, 224. Thereby, the outer channel 208 is maintained adjacent to the inner channel 210 along the side walls 218, 220.

Figure 7:
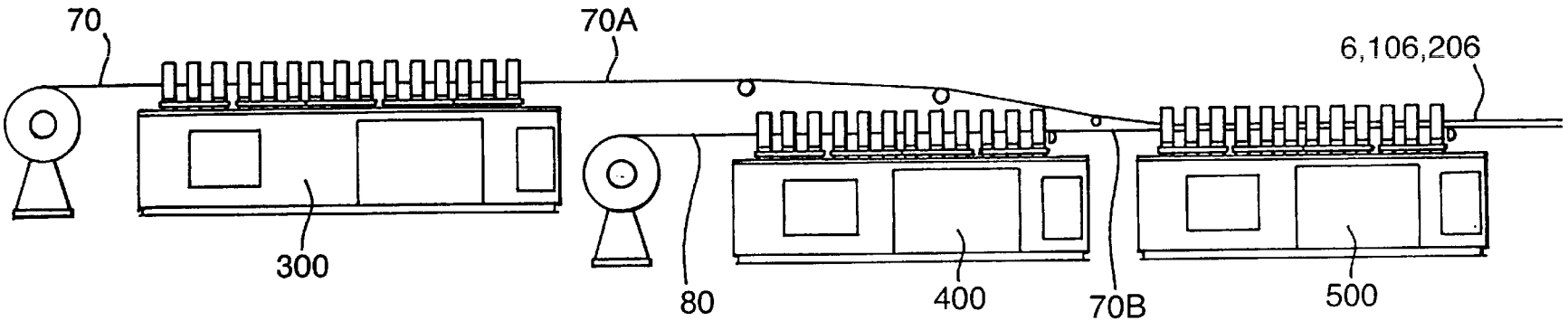
FIG. 7 illustrates schematically a roll-forming apparatus for making the elongate channel of the invention from two metal sheets.

The elongate channels 6, 106, 206 of the head rail 2 of the vertical blind 1 of this invention can be formed by roll-forming, using three sets of mechanically conventional, roll-formers 300, 400, 500 as illustrated schematically in FIG. 7.

A first roll-forming apparatus 300 receives a continuous supply of an elongated first sheet 70 of a metal such as aluminum. The apparatus includes a number of roll-forming stages which progressively form the first sheet 70 into a precursor 70A of an outer channel 8, 108, 208. For example, such roll-forming stages can form the sheet 70 into the fourteen cross-sections of the precursor 70A of the outer channel 208 illustrated in FIG. 8(*a*), going from its stage 1 to stage 14. In this respect, it should be noted that FIG. 8(*a*) shows only one of the symmetric halves of the cross-sections of the precursor 70A during the roll-forming stages.

Similarly, a second roll-forming apparatus 400 receives a continuous supply of an elongate second sheet 80 of a metal such as aluminium or steel and, using a number of roll-forming stages, forms the second sheet 80 into a precursor 80A of an inner channel 10, 110, 210. For example, such roll-forming stages can form the sheet 80 into the eleven cross-sections of the precursor 80A of the inner channel 210 illustrated in FIG. 8(*b*), going from its stage 1 to stage 11. In this respect, it should be noted that FIG. 8(*b*) shows only one of the symmetric halves of the cross-sections of the precursor 80A during the roll-forming stages.

At this time, after the first and second roll-forming apparatuses 300, 400 in FIG. 7, the elongate sheets 70, 80 have each been formed into the precursor 70A, 80A having a cross-section partly conforming to that of the outer and inner channels forming the elongate channel 6, 106, 206 of the invention. The precursor 80A of the inner channel 10, 110, 210 is then guided into the precursor 70A of the outer channel 8, 108, 208. For example, this stage of making the elongate channel 206 is illustrated in stage 1 of FIG. 8(*c*), which again shows only one of the symmetric halves of the cross-sections of the precursors 70A, 80A.

Figure 8A:
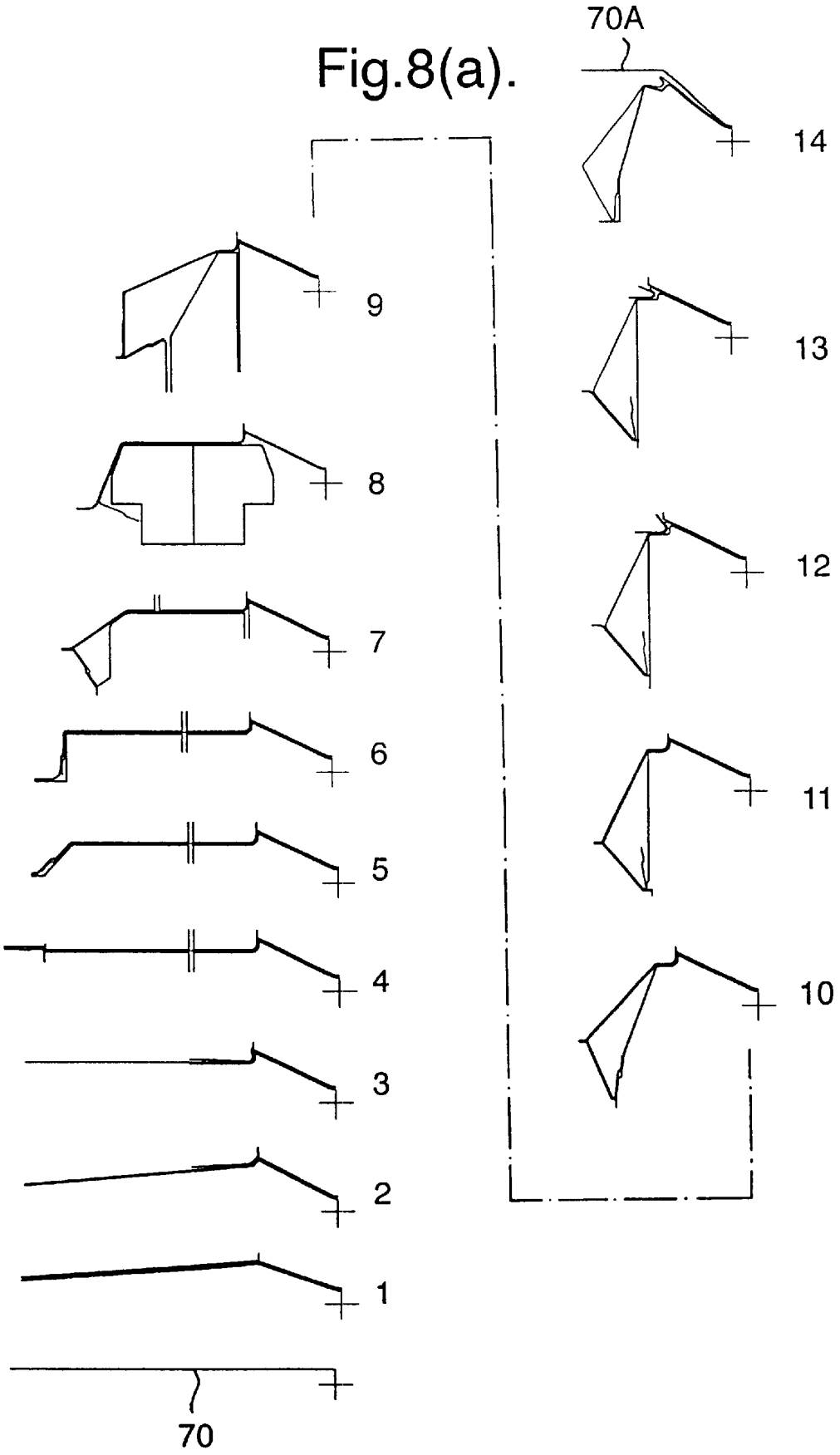
FIG. 8(*a*) illustrates the stages of partly forming the outer channel of the elongate channel of FIG. 6.
Figure 8B:
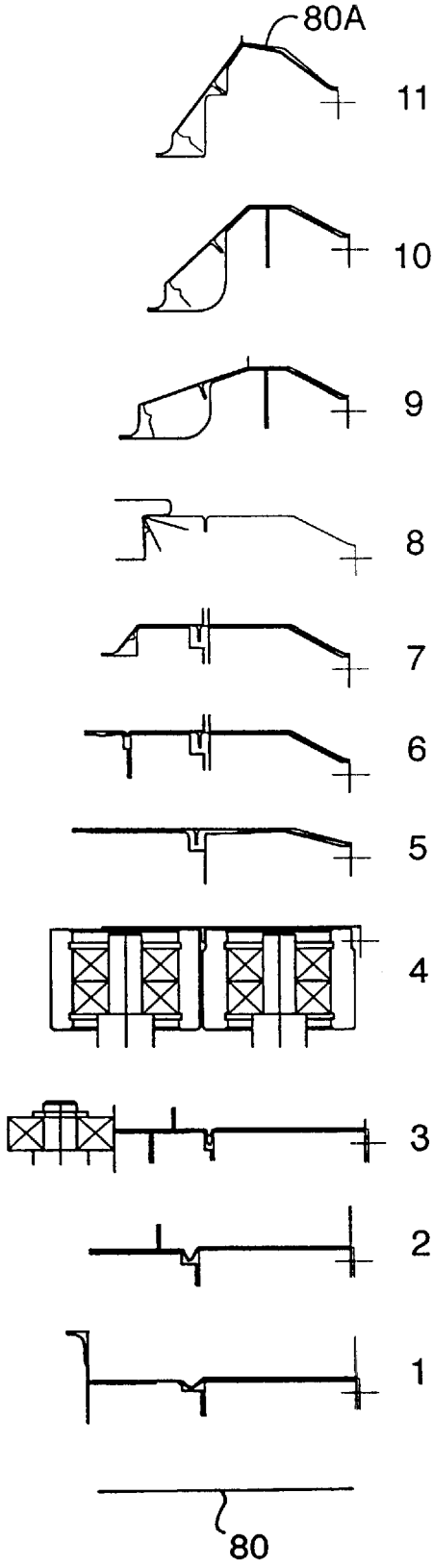
Figure 8C:
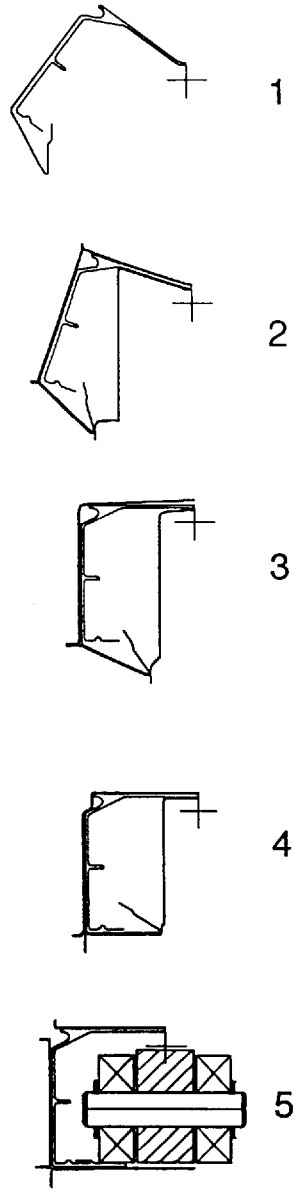

The combined precursors 70A, 80A are then subjected to a third roll-forming apparatus 500 with a number of stages which roll-form the precursors together to produce the elongate channel 6, 106, 206 of the invention. For example, these roll-forming stage of making the elongate channel 206 are illustrated in FIG. 8(*c*), going from its stage 1 to stage 5, which again show only one of the symmetric halves of the cross-sections of the precursors 70A, 80A.

Thus, with the three sets 300, 400, 500 of roll-formers, the desired cross-sections of the elongated channels of the invention can be formed with elongated inner and outer channels, such as 8, 108, 208 and 10, 110, 210, and with any desired length and shape.

The two metal sheets 70, 80 for forming the inner and outer channels can each be made of different materials and/or have different thicknesses. For instance, the sheet 80 for the inner channel can be made of steel, preferably galvanised, whereas the sheet 70 for the outer channel can be made of a lighter material such as aluminum. Indeed, the outer material can also be a surface-coated material.

If desired, the inner and outer channels 10, 110, 210 and 8, 108, 208 can be adhesively bonded together, using a conventional glue 56, 156, and 256, to make the resulting elongate channel 6, 106, 206 more rigid or otherwise enhance its properties.

Likewise, a single shape of an inner channel 10, 110, 210 can be combined with several different shapes of outer channels 8, 108, 208 to obtain a choice of different blind rails, all having the same functional features but differing in exterior shape or decoration as the case may be. This option can be part of a modular system in which portions of the roll-forming equipment can be interchageable for obtaining and joining a different outer channel with a predetermined form of inner channel. For the modular option, it is also conceivable that the inner and outer channels are roll-formed into their respective end shapes by independent roll-forming processes and are separately assembled by endwise sliding of the inner channel into a selected form of the outer channel.

While the embodiments described above are particularly for head rails of vertical vane blinds, the invention is equally suitable for head rails of other types of blinds, such as venetian blinds with horizontally arranged slats, pleated blinds, Roman shades, roller blinds or draw curtains. Indeed, the invention would be suitable for any kind of rail or profile structure, such as ducts or the like.

Although the present invention has been described with a certain degree of particularity, it is understood that the present disclosure has been made by way of example, and changes in detail or structure may be made without departing from the spirit of the invention as defined in the appended claims.

I claim:

1. A blind rail having an elongate channel member, said elongate channel member including an elongate inner channel component and a distinct elongate outer channel component accommodated within said outer channel component, the inner channel component having substantially vertical side walls spaced from each other, and wherein only the inner channel component has support flanges for supporting other components of the blind rail and only the outer channel component has mounting flanges for mounting of the blind rail, the support flanges extending from the substantially vertical side walls.

2. A vertical blind rail having an elongated channel member, the elongated channel member comprising:

an elongated outer channel component for mounting the blind, the outer channel component being (i) comprised of a first substantially rigid material, and (ii) being elongated in a first direction; and an elongated inner channel component for supporting vertical blind components within the blind rail, the inner channel component being (a) comprised of a second substantially rigid material, (b) distinct from the outer channel component, (c) substantially contained within a space defined by the outer channel component, (d) substantially coextensive with the outer channel component in the first direction, (e) substantially the same length as the outer channel component, and (f) fixedly secured to the outer channel component to prevent movement in the first direction relative to the outer channel component.

3. A vertical blind rail according to claim 2, wherein the outer channel component is coated.

4. A method of forming a blind rail according to claim 2 comprising:

roll-forming a first elongate sheet into a cross-section partly conforming to a cross-section of an inner channel component;

roll-forming a second elongate sheet into a cross-section partly conforming to a cross-section of an outer channel component;

feeding the partly roll-formed first elongate sheet into the partly roll-formed second elongate sheet; and roll-forming the first and second elongate sheets together to obtain the blind rail.

5. The blind rail of claim 2, wherein the first rigid material and the second rigid material are different materials.

6. The blind rail of claim 2, wherein the first rigid material and the second rigid material are the same material.

7. The blind rail of claim 2, wherein at least one of the first and second rigid materials is aluminum.

8. The blind rail of claim 2, wherein the second material is steel.

9. The blind rail of claim 2, wherein the outer channel component has a first thickness and the inner channel component has a second thickness, the first thickness being different than the second thickness.

10. The blind rail of claim 2, wherein the inner channel component is fixedly secured to the inner channel component with an adhesive material.

11. The blind rail of claim 2, wherein the inner channel component includes one or more inner channel walls and the outer channel component includes one or more outer channel walls, and wherein a first section of the one or more outer channel walls abuts with and is fixedly secured to an adjacent and corresponding first section of the one or more inner channel walls, and a second section of the one or more outer channel walls is spaced apart from an adjacent and corresponding second section of the one or more inner channel walls.

12. The head rail of claim 11, wherein the first section of the one or more outer channel walls and the first section of the one or more inner channel walls are adhesively bonded together.

13. The blind rail of claim 2, wherein the elongated channel member further comprises spaced apart generally vertically-orientated left and right side walls, each left and right side wall including a generally vertically-orientated inner channel component side wall and a generally vertically-orientated outer channel component side wall, the right wide wall having an inwardly facing support flange extending only from the corresponding inner channel component side wall, and the left side wall having an inwardly facing support flange extending only from the corresponding inner channel component side wall.

14. The blind rail of claim 13, wherein the support flanges of the left and right side walls are formed by folding the corresponding inner channel component side wall back onto itself.

15. The blind rail of claim 2, wherein:

the outer channel component comprises (i) a substantially horizontally-orientated outer base wall spanning between first and second outer base edges, (ii) substantially vertically-orientated first and second outer side walls extending respectively from the first and second outer base edges to respective first and second outer side edges, and (iii) generally horizontal first and second outer inturned flanges extending inwardly respectively from the first and second outer base edges towards respective first and second outer flange edges, a space between the first and second outer flange edges defining a slot therebetween; and the inner channel component comprises (a) a substantially horizontally-orientated inner base wall spanning between first and second inner base edges, (b) substantially vertically-orientated first and second inner side walls extending respectively from the first and second inner base edges to respective first and second inner side edges, and (c) generally horizontal first and second inner inturned flanges extending inwardly respectively from the first and second inner base edges towards respective first and second inner flange edges.

16. A blind rail according to claim 15, wherein, said outer channel component is formed from an elongate-sheet and the first rigid material is a metal.

17. A blind rail according to claim 16 wherein, at least one of said first and second outer base edges, the sheet forming the outer channel component is folded back on itself so as to form a mounting flange extending outwardly, whereby the mounting flange can be used to mount the blind rail adjacent to an architectural opening.

18. A blind rail according to claim 17 wherein, adjacent said mounting flange, the sheet of said outer channel component forming said first outer side wall is folded back on itself forming an extension extending in generally an upward direction so as to hide or cover said mounting flange.

19. A blind rail according to claim 15, wherein, said inner channel component is formed from an elongate sheet and the second rigid material is a metal.

20. A blind rail according to claim 19 wherein, at a position intermediate said first and second inner base edges and said first and second inner side edges respectively, the sheet forming the inner channel component at least one of the first and second inner side walls is folded back on itself so as to form an inwardly-extending support flange, whereby blind components can be supported or retained by the support flange.

21. A blind rail according to claim 15, wherein said first outer inturned flange has a concave transition section connecting it to the first outer side wall and wherein said transition section is at least partly of concave outer form.

22. A blind rail according to claim 15, wherein said first and second outer inturned flanges are each reverse bent back on itself at the respective first and second outer flange edges so as to at least partially overlap on the respective first and second inner inturned flanges.

23. The blind rail of claim 15, wherein the first and second outer inturned portions are each (i) reverse bent back on to itself at the respective first or second outer flange edge, and (ii) overlap a respective first or second inner flange edge.

24. A blind rail having an elongate channel member, said elongate channel member including an elongate inner channel member for supporting or retaining blind components and an elongate outer channel member having means for mounting of the rail, said inner channel member being accommodated within said outer channel member, said elongate channel member further including a base wall extending width wise in a first direction between first and second base edges, first and second side walls, the first side wall extending from said first base edge to a first side edge in a second direction generally perpendicular to said first direction and the second side wall extending from said second base edge to a second side edge in said second direction generally perpendicular to said first direction, first and second in-turned flanges extending inwardly from said first and second side edges respectively in generally said first direction so as to define a slot therebetween and wherein said base wall, said first and second side walls and at least part of said first and second in-turned flanges respectively include an inner base wall, first and second inner side walls and first and second inturned inner flanges of said channel member, said outer channel member being formed from an elongate sheet of metal material wherein the sheet forming a first outer side wall of said outer channel member between the first base edge and the first side edge is spaced apart from said first inner side wall.

25. A blind rail according to claim 24 wherein said first outer side wall has a generally convex or outwardly curved outer form.

26. A vertical blind rail having an elongated channel member, the elongated channel member comprising:

an elongated outer channel component for mounting the blind rail, the outer channel component being (i) comprised of a first substantially rigid material, and (ii) being elongated in a first direction; and an elongated inner channel component for supporting vertical blind components within the blind rail, the inner channel component being (a) comprised of a second substantially rigid material that is different than the first substantially rigid material, (b) distinct from the outer channel component, (c) substantially contained within the outer channel component, (d) substantially coextensive with the outer channel component in the first direction, (e) substantially the same length as the outer channel component, and (f) fixedly secured to the outer channel component to prevent movement in the first direction relative to the outer channel component.

27. The blind rail of claim 26, wherein the outer channel component has a first thickness and the inner channel component has a second thickness, the first thickness being different than the second thickness.

28. A vertical blind rail having an elongated channel member, the elongated channel member comprising:

an elongated outer channel component for mounting the blind, the outer channel component being (i) comprised of a first substantially rigid material, and (ii) having one or more outer walls; and an elongated inner channel component for supporting vertical blind components within the blind rail, the inner channel component having one or more inner walls and being (a) comprised of a second substantially rigid material, (b) distinct from the outer channel component, and (c) substantially contained within the outer channel component;

wherein a first section of the one or more outer walls abuts with and is fixedly secured to an adjacent and corresponding first section of the one or more inner walls, and a second section of the one or more outer walls is spaced apart from an adjacent and corresponding second section of the one or more inner walls.

29. The blind rail of claim 28, wherein the first section of the one or more outer walls is adhesively bonded to the first section of the one or more inner walls.

30. The blind rail of claim 28, wherein (A) the one or more outer walls comprise (i) generally vertically-orientated spaced apart left and right outer side walls, and (ii) a generally horizontally-orientated outer base wall, the outer base wall intersecting with the left and right outer side walls along respective elongated left and right outer edges, and (B) the one or more inner walls comprise (i) generally vertically-orientated spaced apart left and right inner side walls, and (ii) a generally horizontally-orientated inner base wall, the inner base wall intersecting with the left and right inner side walls along respective elongated left and right inner edges, and wherein the first section of the one or more outer walls comprises at least part of one of the left and right outer side walls, and the first section of the one or more inner walls comprises at least part of one of the left and right inner side walls.

31. The blind rail of claim 30, wherein the second section of the one or more outer walls comprises at least part of the outer base wall, and the second section of the one or more inner walls comprises at least part of the inner base wall.

32. The blind rail of claim 31, wherein the second section of the one or more inner walls is adhesively bonded to the second section of the one or more outer walls.

33. A blind rail according to claim 28, wherein the second section of the outer channel component has an outwardly convex form.

34. A vertical blind rail having an elongated channel member, the elongated channel member comprising:

an elongated outer channel component for mounting the blind, the outer channel component being comprised of a first substantially rigid material in the form of (i) a substantially horizontally-orientated outer base wall spanning between first and second outer base edges, (ii) substantially vertically-orientated first and second outer side walls extending respectively from the first and second outer base edges to respective first and second outer side edges, and (iii) generally horizontal first and second outer inturned flanges extending inwardly respectively from the first and second outer base edges towards respective first and second outer flange edges with a space between the first and second outer flange edges defining a slot therebetween, and an elongated inner channel component for supporting vertical blind components within the blind rail, the inner channel component being comprised of a second substantially rigid material that is distinct from the outer channel component and in the form of (a) a substantially horizontally-orientated inner base wall spanning between first and second inner base edges, (b) substantially vertically-orientated first and second inner side walls extending respectively from the first and second inner base edges to respective first and second inner side edges, and (c) generally horizontal first and second inner inturned flanges extending inwardly respectively from the first and second inner base edges towards respective first and second inner flange edges;

wherein the first and second outer inturned flanges are each reverse bent back on to itself at the respective first or second outer flange edge, and overlap a respective first or second inner flange edge.

35. A vertical blind rail having an elongated channel member, the elongated channel member comprising:

an elongated outer channel component for mounting the blind, the outer channel component being (i) comprised of a first substantially rigid material; and an elongated inner channel component for supporting vertical blind components within the blind rail, the inner channel component being (a) comprised of a second substantially rigid material, (b) distinct from the outer channel component, (c) substantially contained within the outer channel component, (d) fixedly secured to the outer channel component to prevent movement relative to the outer channel component, and (e) substantially the same length as the outer channel component;

wherein the elongated channel includes a pair of inwardly-extending support flanges, one support flange of the support flanges being integral with only a first wall of the inner channel component, and the support flange of the pair of support flanges integral with only a second wall of the inner channel component, the first wall being opposite and facing the second wall, the pair of support flanges being configured to support vertical blind components.

36. The blind rail of claim 35, wherein the pair of support flanges extend in a substantially horizontal direction.

* * * * *